US006224314B1

(12) United States Patent
Mann

(10) Patent No.: US 6,224,314 B1
(45) Date of Patent: May 1, 2001

(54) UNIVERSAL RACK LOADING/UNLOADING SYSTEM

(76) Inventor: Robert K. Mann, 1315 Jumana Loop, Apollo Beach, FL (US) 33572

( * ) Notice: Subject to any disclaimer, the term of this patent is extended or adjusted under 35 U.S.C. 154(b) by 0 days.

(21) Appl. No.: 09/238,544

(22) Filed: Jan. 28, 1999

Related U.S. Application Data

(60) Provisional application No. 60/072,898, filed on Jan. 28, 1998.

(51) Int. Cl.[7] ..... B65G 67/02

(52) U.S. Cl. ..... 414/392; 212/326; 414/399; 414/626

(58) Field of Search ..... 414/139.9, 140.2, 414/391, 392, 399, 508, 561, 573, 626; 198/346, 468.6; 212/326; 294/67.1

(56) References Cited

U.S. PATENT DOCUMENTS

| | | | | |
|---|---|---|---|---|
| 1,990,539 | * | 2/1935 | Fildes | 212/326 |
| 2,718,972 | * | 9/1955 | Temple | 414/392 X |
| 3,420,211 | * | 1/1969 | Hartvickson | 198/346 X |
| 4,027,823 | * | 6/1977 | Kawarai et al. | 414/392 |
| 4,059,194 | * | 11/1977 | Barry | 414/391 X |
| 4,568,233 | * | 2/1986 | Baker et al. | 414/561 X |
| 4,756,401 | * | 7/1988 | Kempton | 198/468.6 |
| 5,325,953 | * | 7/1994 | Doster et al. | 198/346 X |
| 5,567,112 | * | 10/1996 | Balzano | 414/139.9 X |

FOREIGN PATENT DOCUMENTS

| | | | | |
|---|---|---|---|---|
| 1022130 | * | 2/1953 | (FR) | 414/392 |

* cited by examiner

*Primary Examiner*—James W. Keenan
(74) *Attorney, Agent, or Firm*—Pendorf & Cutliff

(57) ABSTRACT

A universal rack loading/unloading system and method of using such a system includes a transfer station for receiving the truck bed of a truck. A monorail is fixedly attached to the transfer station. The monorail has at least one snatch winch that is coupled thereto and capable of traversing a length of the monorail. Also, a first rail system is formed by a pair of parallel track members and fixedly attached to the second support frame of the transfer station. A conveyance trolley is slidable mounted to the first rail system. A universal rack being suspended from the snatch winch of the monorail for supporting a load of material to be moved through a processing plant. The truck bed is unloaded and jigged simultaneously at the transfer station for movement of the material through the plant for processing.

8 Claims, 4 Drawing Sheets

UNIVERSAL RACK LOADING/UNLOADING SYSTEM

This application claims the benefit of U.S. Provisional No. 60/072,898 filed Jan. 28, 1998.

BACKGROUND OF THE INVENTION

1. Field of the Invention

The present invention relates to a universal rack loading/unloading system and more particularly pertains to providing a series of automated apparatus cooperating one with the other for material handling, by unloading material from a flatbed trailer for processing within a industrial plant environment and reloading the processed material on to a flatbed trailer.

2. Description of the Prior Art

The use of an overhead crane and rail system for moving materials is known in the prior art. More specifically, overhead cranes heretofore devised and utilized for the purpose of industrial lifting are known to consist basically of familiar, expected and obvious structural configurations, notwithstanding the myriad of designs encompassed by the crowded prior art which have been developed for the fulfillment of countless objectives and requirements.

In most processing plants the material is unloaded from the truck and placed in a staging area. The material is generally removed through the use of a forklift. Once the material is completely unloaded, another forklift truck will carry a few pieces of material to the black metal jigging area where they are negotiated onto a rack in preparation of galvanizing. Industrial plant use a variety of methods to unload the trucks, move the material from the staging area to conveyor for moving to the processing area, then loading the material for processing. The procedure is reversed once the material has been processed.

By way of example, the prior art includes U.S. Pat. No. 5,735,217 to Halbig et al. Halbig et al. has a rail-type conveyor system that has dispatching and receiving stations with self propelling container trucks. In Halbig the container trucks have unlockable loading and/or loading means. Further, the dispatching and/or receiving stations have at least one stopping point with the delivery and/or receiving means for automatic loading and/or unloading. The receiving means contains a catch basket and a rail section that is pivotally mounted about a pivot axis on its unloading side. The rail section has two current carrying rails and a control rail for controlling a container truck. The material being unloaded from the container truck is loaded into the catch basket. The catch basket is moved along the rail track of the station. The unloading and loading of the material from the container truck of this invention differs greatly from applicants. In Halbig, the bed of the container truck rotates between stations for loading and unloading. Each of the stations has a catch basket mounted onto a rail system for movement of the material. The material is loaded from the side of the truck bed. Our invention does not require movement of the truck bed and the loading and unloading is done from over the truck bed.

One of the more recent bridge crane apparatus is U.S. Pat. No. 5,593,050 to Lange. The bridge crane of Lang has two transverse bearers that extend parallel to one another and constitute a track for the traveling crane and folding lateral parts, respectively pivoted at the ends of the bearers, for selective extension of the track. The crane is used for loading and unloading materials from ships.

Another development in systems for unloading and loading material in an industrial plant and movement of the material for processing is disclosed in U.S. Pat. No. 5,171,120 to Bernard, II et al. Bernard teaches an integrated warehousing system for storing and retrieving goods as well as preparing the goods for their ultimate disposition. The system is an automated system that has a continuous series of mechanisms that are integrated to efficiently manage warehousing material handling operations. A part of the system is a conveyor network for delivering selected containers from the storage carousel to the work center with a control means. The storage carousel is made up of a rack that supports containers of material. The containers of material are moved about a table type of conveyor between the storage carousel and the work center.

When handling elongated material jigs are used. One such jig is disclosed in U.S. Pat. No. 4,541,766 to Dahl. The jig handles packs of elongated material and is adapted to support the pack of material during handling and bringing it to the appropriate position in front of the input opening of the rack for the transfer of the loaded material to the rack. The jug of Dahl has a length that corresponds to the length of the material to be handled. The jig has a frame structure and transverse rollers journaled across the frame's width. The jig has fork receiving means for receiving the forks of a forklift truck for transporting. This process is slow and time consuming because the material still has to be handled by another loading apparatus for processing.

Monorail systems are commonly used for transporting material in a plant environment. U.S. Pat. No. 4,339,031 to Densmore teaches a monorail suspended conveyor system. This systems conveys materials along a curviliner path and has a plurality of tandemly disposed belt supporting carriages.

Another overhead crane system is the universal gentry crane of U.S. Pat. No. 4,106,641 to Campbell et al. This patent teaches a traveling gantry crane with a shuttle girder and a load carrying trolley mounted for movement along the shuttle girder. The shuttle girder has a hoisting trolley that travels a distance twice as long s the travel distance of the shuttle girder. Further, the shuttle girder and the load carrying trolley operate in a side-by-side arrangement with each other and with the bridge girder in order to provide minimum interference with the movement of each, and maximum outreach of the shuttle girder and load carrying trolley with respect to the bridge girder of the gantry.

An earlier overhead crane apparatus is taught in U.S. Pat. No. 3,786,936 to Staadt. This overhead crane is adapted for universal movement in a horizontal plane. The crane includes a pair of bridge members that span the width of an industrial plant and has guide wheels adapted to be driven along rails running longitudinally along the sides of the plant.

In the prior art a tractor and a flatbed trailer loaded with metal shapes to be galvanized enters a plant. Usually the tractor and flatbed is weighted on a scale. The Driver enters the scale house office and presents his load manifest and receives truck weight, paperwork computer generated material and identification tags. Enough metal tags will be issued to identify the customers' material during all stages of the galvanizing process. Therefore, this material can be traced at any time. The Tags are attached to a universal rack when the material is jigged.

The universal rack loading/unloading system according to the present invention substantially departs from the conventional concepts and designs of the prior art, and in so doing provides a system primarily developed for the purpose of allowing a series of automated apparatus to cooperate one with the other for material handling from the flatbed trailer and providing for continuous movement from the flatbed until processed within an industrial plant environment.

Therefore, it can be appreciated that there exists a continuing need for a new and improved universal rack loading/unloading system which can be used for providing a series of automated apparatus cooperating one with the other for material handling and processing within an industrial plant environment. In this regard, the present invention substantially fulfills this need.

SUMMARY OF THE INVENTION

Accordingly, a primary of the universal rack loading/unloading system is to provide an efficient way to unload material from a flatbed trailer such that the materials may be moved about for handling in a galvanizing plant or a processing line. As such, the general purpose of the present invention, will be described subsequently in greater detail.

To attain this, the present invention essentially entails driving a flat bed truck trailer into a transfer station. The transfer station is composed of two support structures that have a common center support frame. A monorail is extended length wise between the two support structure. Positioned on the monorail are a pair of snatch winches that are used to releasablely support a universal rack. When the truck drives into the transfer station it has a load of black metal material. To unload, the material is jigged by persons waiting to unload the trailer.

During jigging the metal that is to be galvanized by suspending it from the universal rack. Everything to be galvanized hangs such that when the universal rack is lowered it does not go into the chemical vats such as an acid bath, a degreasing bath, fluxes or even the kettle that does the galvanizing. The universal rack holds the materials suspended below it and lowers the material down far enough to allow the materials to be completely immersed into the vats. These universal racks are generally the length of the process vats or the galvanizing kettle. The material is first moved from the transfer station to a rail system by the monorail.

The kettle used in the galvanizing process is usually 45 feet long, 7 feet wide and 11 feet deep. The dipping usually does not go within a foot of the bottom of the kettle. With the molten hot galvanize zinc at 844° F. plus or minus 10°, a foot in the bottom is needed to control heat and provide space for dross. The universal rack is 7 feet wide by 45 feet long by however tall it needs to be in profile to be able to span that distance. There is an imaginary space under that rack that is ten feet deep. The walls of the vats limit the size of the universal rack. A clearance of six inches from the sides of the vat is usually desired.

The universal rack is loaded by people that are technically oriented and schooled to know that it has to balanced and not exceed that imaginary envelope that is 44 feet by 6 feet by approximately 10 feet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved universal rack loading/unloading system which has all the advantages of the prior art overhead cranes.

Another object of the present invention to provide a new and improved universal rack loading/unloading system that allows the truck to be positioned in the unloading bay of the processing plant for removal of the material to be processed.

A further object of the present invention is to provide a new and improved universal rack loading/unloading which is of a durable and reliable construction that allows the truck unloading and rack jigging to be preformed simultaneously.

An even further object of the present invention is to provide a new and improved universal rack loading/unloading system loading and unloading system which is susceptible of a low cost of manufacture with regard to both materials and labor, and which reduces the need to unload the truck then jig the material and move the material through the plant for processing.

Still yet another object of the present invention is to provide a new and improved universal rack loading/unloading system which provides in the apparatuses and methods of the prior art some of the advantages thereof, while simultaneously overcoming some of the disadvantages normally associated therewith.

Still another object of the present invention is to providing a series of automated apparatus cooperating one with the other for material handling and processing within an industrial plant environment.

Yet, still another object of the present invention is to provide a universal rack loading/unloading system that assists with reloading of the processed material on to the flatbed trailer/truck.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
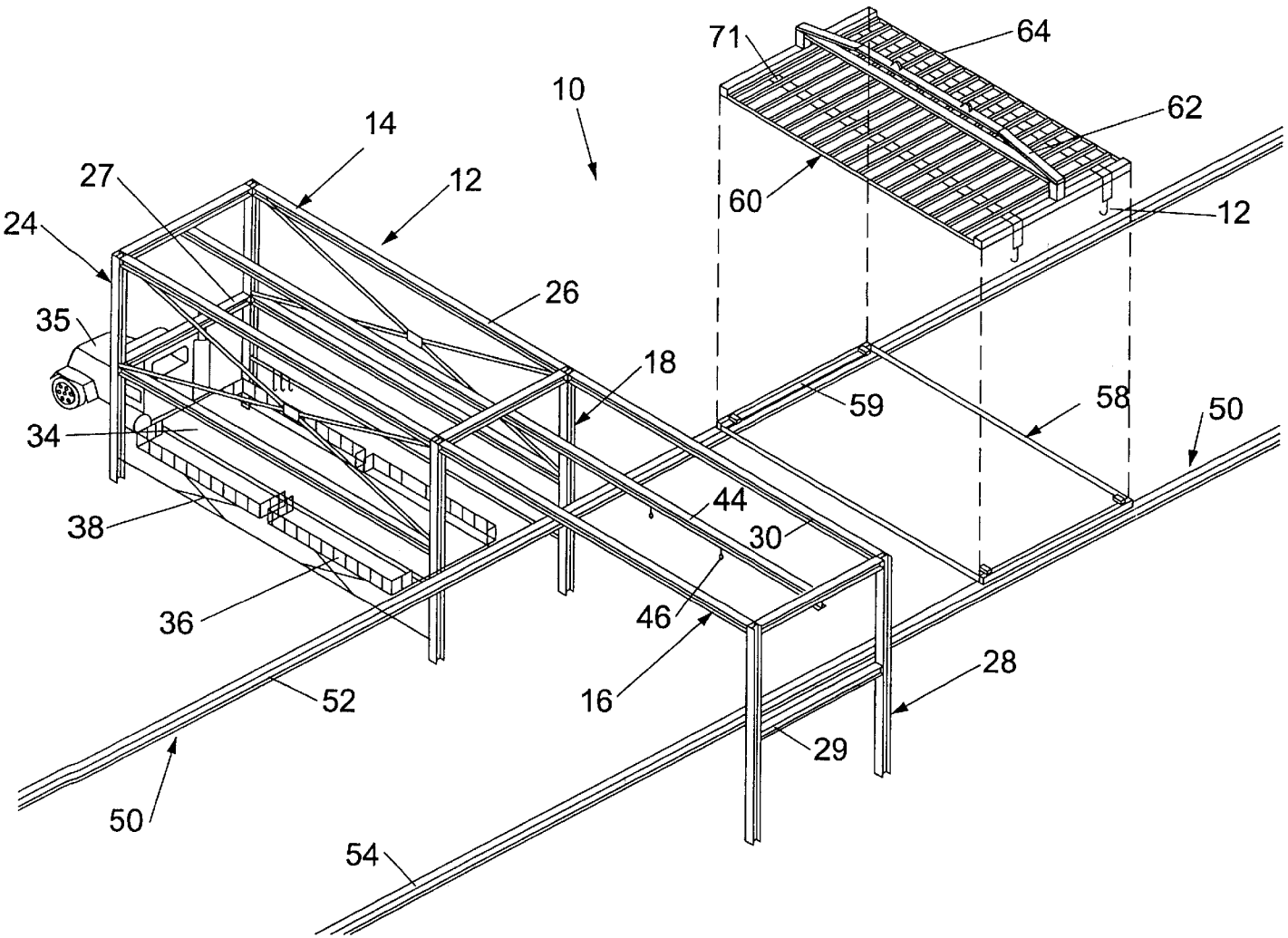
FIG. 1 is a perspective illustration of the preferred embodiment of the universal rack loading/unloading system constructed in accordance with the principles of the present invention.
Figure 1A:
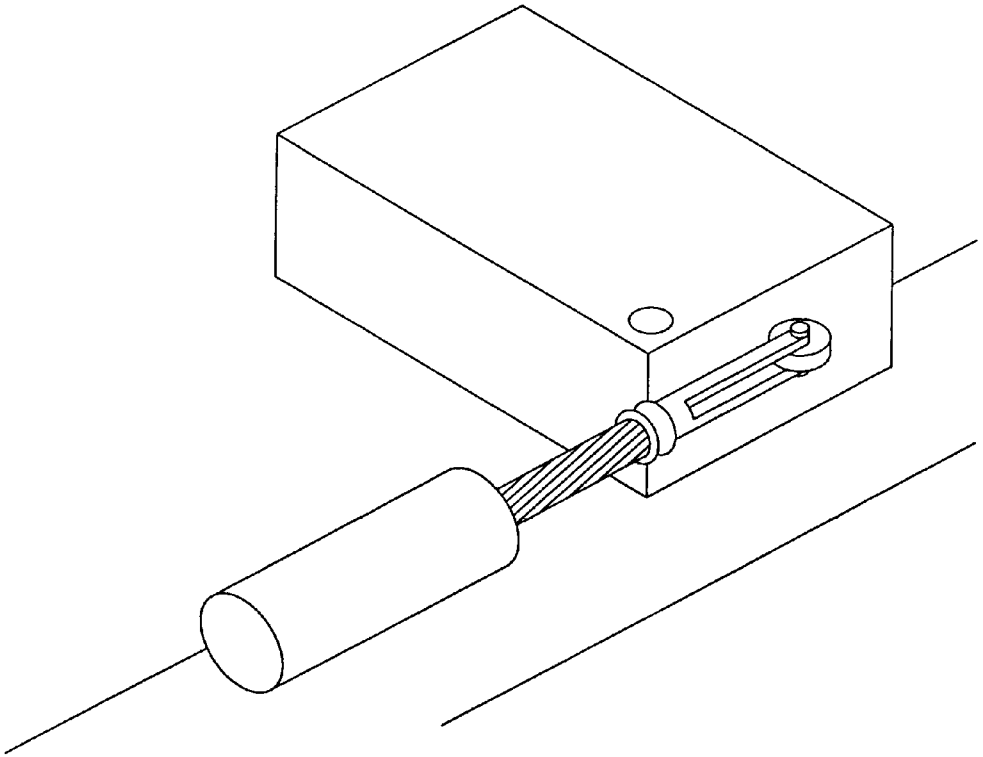
FIG. 1A is an isometric illustration of the preferred embodiment of the universal rack support detail of the present invention.

With reference now to the drawings, and in particular to FIG. 1 thereof, a universal rack loading/unloading system embodying the principles and concepts of the present invention and generally designated by the reference numeral 10 will be described.

The present invention, the new and improved universal rack loading/unloading system, is comprised of a plurality of components. Such components in their broadest context include a transfer station, adjustable work platform, monorail, universal rack and rail system. Such components are individually configured and correlated with respect to each other so as to attain the desired objective.

More specifically, the present invention includes a universal rack loading/unloading system 10 that has a transfer station 12. The transfer station has a first support structure 14 and a second support structure 16 with a common center support frame 18. The first support structure has a first support frame 24 coupled with the center support frame by a first pair of side bar members 26. The first support frame has a first support bar 27 that ensures the stability of the first support frame. The second support structure has a second support frame 28 coupled with the center support frame by a second pair of side bar members 30. The second support frame has a second support bar 29, that provides identical support to the second support frame as the first support bar provides to the first support frame. In the event the loading dock area is a reclined loading dock, the first support frame of the first support structure could have a greater length. The first support structure is sized for receiving the flatbed of a truck trailer 34. It is to be understood that the height of the transfer station's support frames would vary in accordance with the design of the unloading and loading docks. The design will accommodate flat, reclined or inclined docks.

As illustrated in FIG. 1, a plurality of adjustable work platforms 36 are housed within the first support structure. The adjustable work platforms are spaced apart for receiving the truck trailer. Each work platform has a lift 38 for raising and lowering the platform. The lift may be a mechanically operated lift or a hydraulic lift. The controls for the lift of each platform are located on the platform to allow each platform to be raised or lowered to accommodate the needs of the workers 40. The work platform is positioned along side the truck trailer and is raised or lowered for positioning of the people/workers that will assist with loading and unloading the truck. Each platform is has a safety rail 42 that extends along each side and the rear of the work platform. The safety rail may be omitted from the platform. The safety rails assist in preventing workers from falling off the work platforms.

A monorail 44 is fixedly attached to the first support frame of the first support structure 14, the center support frame and the second support frame of the second support structure 16. The monorail has at least one snatch winch 46 is coupled thereto and capable of traversing a length of the monorail. Preferably, a pair of snatch winches are coupled with the monorail. The snatch winches reversibly move along the monorail between the first support frame and the second support frame. The reversible movement of the snatch winches is controlled by electrical operated guide wheels. The guide wheels may operate by a conventional roller support carriage (not shown). The carriage may be adapted to be guided along the monorail by roller pairs positioned on the monorail. Additionally, each snatch winch of the pair of snatch winches has a means for lowering it down from the monorail and then raising it up to be returned to their original position. The hoist means may be a conventional electrically operated hoist or a manually operated hoist.

Also, a first rail system 50 is formed by a pair of parallel track members. The parallel members are fixedly attached to the second support frame 28, as seen in FIG. 1. The pair of parallel track members has a first track member 52 which is fixedly attached to the center frame 18 and a second track member 54 which is fixedly attached to the second support frame. The first rail system is in a plane perpendicular to the side bars of the second support structure.

Coupled with the pair of parallel track members of the rail system is a conveyance trolley 58. The conveyance trolley has trolley trucks 59 that are slidablely mounted to the first rail system.

Included is a universal rack 60. The universal rack is suspended from the snatch winches 46 of the monorail to support a load of material. The material is either black metal that is unloaded from the truck trailer or coated metal to be reloaded onto the truck trailer. The universal rack is used to move the material through a processing plant along the rail system. The universal rack has a grab bar 62 with at least one grab loop 64 for releasable coupling with the snatch winch 46. Preferably, the grab bar has a pair of grab loops. The universal rack is positioned onto the conveyance trolley for transporting the load of material along the rail system and removed from the conveyance trolley for reloading of the material onto the truck trailer 34.

Also, the universal rack has a plurality of small monorails 71 extending the length of the universal rack. Each of the small monorails has a plurality of jig winches 72 for coupling with jig hooks positioned around the material to assist with lifting the material off the truck. Each of the plurality of jig winches are capable of reversible movement along the small monorail, as well as up and down movement. The up and down movement of the jig winches and the reversible movement is similar to the movement of the snatch winches of the large monorail 44 of the universal rack.

In operation the flat bed trailer of a truck 35 is positioned in the bay of the processing plant. The truck is carrying a load of material 65 to be processed, into a transfer station. The transfer station has a first support structure and a second support structure with a common center support frame. The bed of the truck is positioned between a plurality of adjustable work platforms that have people 40 standing thereon to unload the material from the truck. The windshield of the truck is marked for future positioning within the first support structure of the transfer station.

A universal rack, suspended from a monorail with a pair of snatch winches, is slid from the second support structure to the first support structure. The universal rack is lowered with the pair of snatch winches to a position just above the material on the truck and within reach of the people standing on the plurality of adjustable work platforms.

Figure 3:
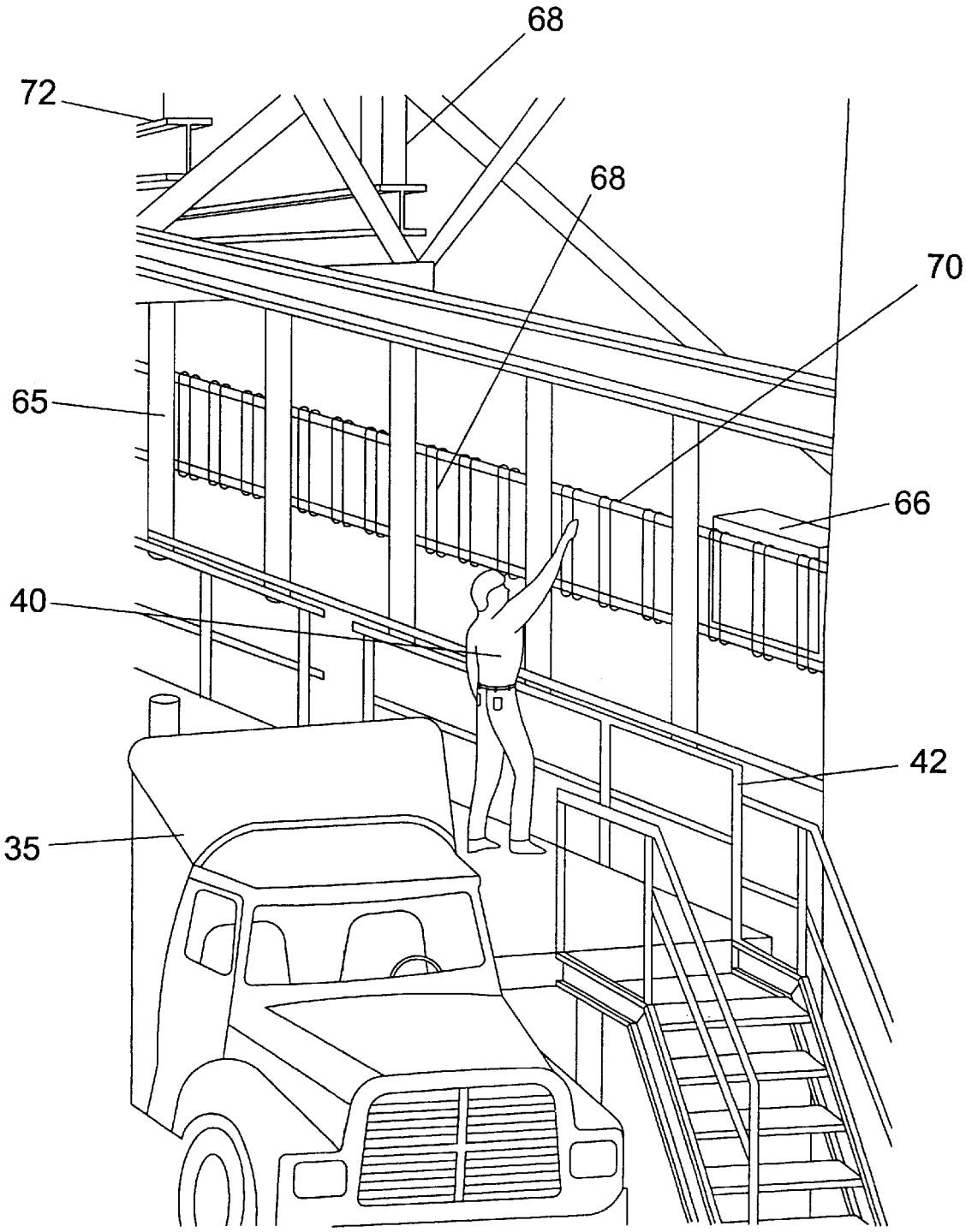
FIG. 3 is an illustration of the material being unloaded and jigged for suspension from the universal rack.

The movement of the universal rack is controlled from a control box 66. The control may be positioned on the first support frame as shown in FIG. 3, or on at least one of the adjustable work platforms, or at another location in the plant. The plurality of adjustable work platforms are raised to a height that allows the people to reach the material in the truck. A jig hook 68 is removed from a jig wire 70 that is supported between a first support frame and the center frame of the first support structure. The people on the adjustable work platforms 36 are used to lift one piece of the material off the truck. The people couple one end of the jig hook to the material and couple another end of the jig hook to the universal rack to suspend the material from the universal rack. The lifting of the material and jigging are done simultaneously. The steps of lifting the material from the truck and suspending the material from the universal rack by using the jig hook is repeated until the bed of the truck is empty or the universal rack is full.

The universal rack is then lifted so that the material is suspended in a vertical orientation to the universal rack, as depicted in FIG. 3. The universal rack, with the suspended material, is slid along the monorail to the second support structure. The universal rack is lowered onto the conveyance trolley 58. The conveyance trolley is supported by a rail system. The rail system is formed of a first rail track and a second rail track. The first rail track is fixedly attached to the center frame and the second rail track is fixedly attached to a second support frame of the second support structure. The conveyance trolley, with the universal rack and suspended material, is slid along the rail system for positioning above a processing vat. The universal rack is lowered to allow the suspended material to enter into the processing vat for cleansing. The universal rack is raised with the suspended material out of the processing vat. The conveyance trolley is slid along the rail system for positioning above a kettle of molten zinc. The universal rack, with the suspended material having been cleaned, is lowered into the molten zinc. The universal rack is raised and the material is removed from the kettle of molten zinc wherein the zinc has coated the material.

Once removed the zinc coated material is allowed to dry. Once dry the conveyance trolley is moved along the plant to a position under the second support structure. The pair of snatch winches are lower and couple with the pair of grab loops of the universal rack. The universal rack, with the coated material, is raised and moved to be positioned over the truck trailer. The workers then reverse the unloading process for the coated material to remove the material from the universal rack and reloading the truck.

In a normal situation, a driver will continue forward to a truck-unloading bay. The technician will direct the truck to the exact truck unloading station. On the first visit, the truck interior windshield will be clearly marked with a 1/32 by 3-inch long very fine translucent red plastic line. This line will be used on all subsequent trips to precisely position the truck for unloading, jigging or loading.

Figure 2:
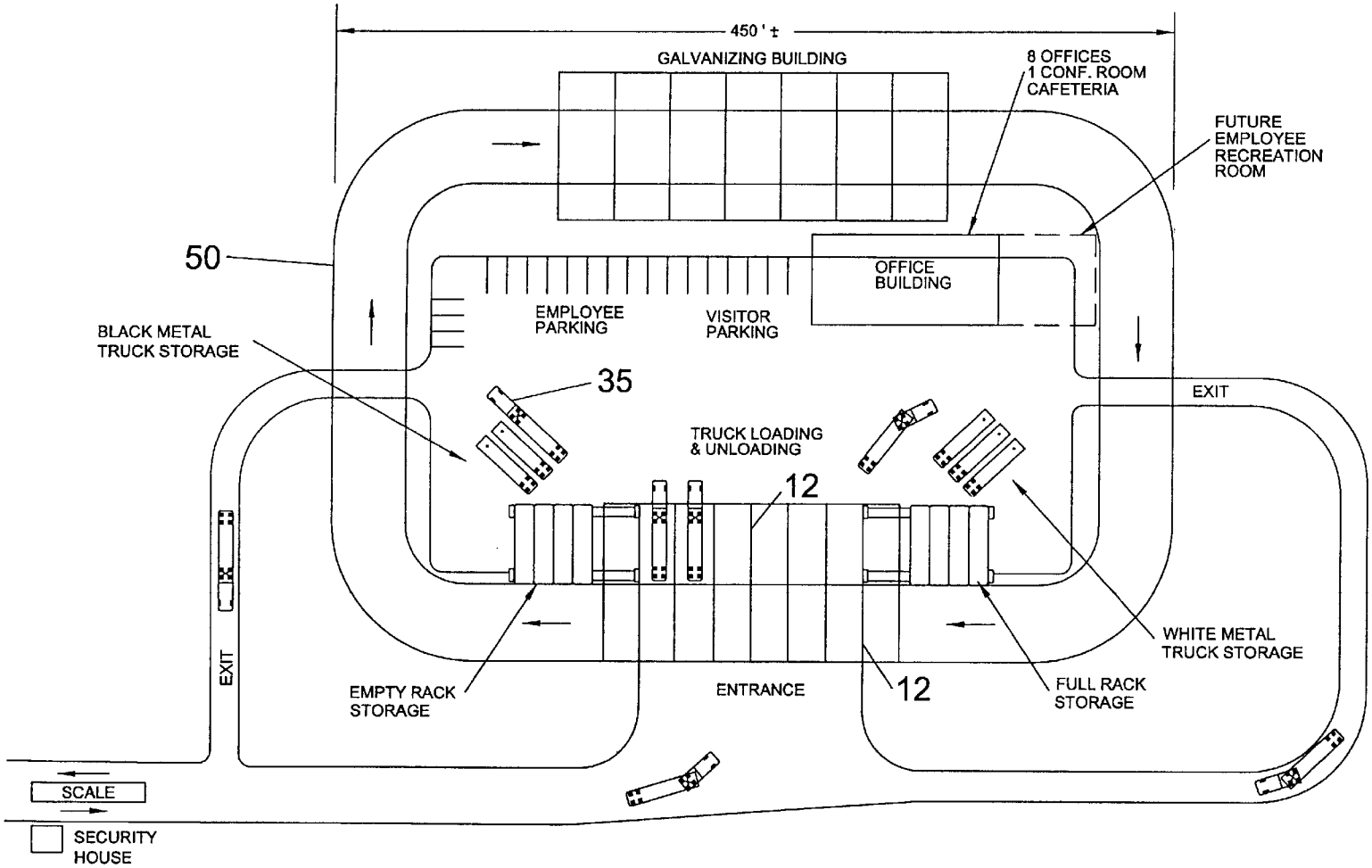
FIG. 2 is a perspective illustration of the movement of material along the rail system from unloading to reloading the truck.

The technicians will start to unload the truck at a transfer station. The truck is driven into the transfer station as shown in FIG. 2. The technicians will jig the universal rack by using an adjustable height universal rack. The universal rack is positioned over the truck by a monorail and suspended by at least one winch. The universal rack loading/unloading system will have at least one monorail with snatch winches attached. These winches are used to help the workers load and unload the universal rack.

Controls will operate at least one winch or two winches that will allow the universal rack to be lowered to whatever height needed above the truckload. If the truck is full, then obviously the load might be as much as 8 feet above the bed of the truck. The work platforms where workers stand, moves up and down to facilitate the loading and unloading of the universal rack. The ability to move the work platform and the universal rack up or down greatly facilitates the loading and unloading of the truck or the universal rack. The amount lowered or raised depends on the size and shape of the material on the truck. Ideally, the order of loading the rack should be almost opposite of the manner in which the truck was loaded. If you load a truck you usually have the very heaviest materials on the flatbed and the lighter materials on top.

In the galvanizing plant, the rack is loaded so that the heaviest materials requiring the greatest amount of zinc have the longest time in the zinc kettle. The lighter material spends a lot less time in the kettle. Being lighter the temperature of the lighter metals rises faster than the temperature of the heavier metals. The heavy metal, being thicker and it should go into the vat first and should come out of the solution last.

Truck unloading and rack jigging will be performed simultaneously. The work platform stations will be equipped with torches, drum motors, service air, large and small grounders, stud welding machines and all necessary jig hooks wires miscellaneous tools and anything required to prepare the material for the galvanizing line.

The trolley truck is moved on a rail system through the plant constructed like a racetrack. In the loading unloading transfer stations after loading the universal rack, the rack is moved on the monorail to a point where the rack can be transferred to the conveyance trolley.

The universal rack is mounted on the trolley truck. The trolley truck has a rack support where the universal rack rests. The rack support must be taken out of the path of the universal rack when it is lowered. The rack support in the drawing is pivoted out of the path of the universal rack by a piston, when there is a need to lower the rack into a vat. Pre stop limit switches can be used to stop the movement of the trolley when the rack is over a vat. The material is conveyed to the galvanizing line for processing, the tracks and the trolley will convey the racks with material through the entire line to selected vats. A universal rack and truck trolley full of material can be moved particular quickly between vats by conveying the rack on the racetrack. Fixed winches above the universal trolley can be used to lower the rack into a vat and raise the rack and place it on the trolley. These fixed winches do away for the need of bridge cranes. The fixed winches can be used to raise and lower the material in the vat every fifteen minutes. Automatic cycling can be achieved by using fixed winches.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, equitably entitled.

What is claimed is:

1. A universal rack loading/unloading system comprising:

a transfer station having a first support structure and a second support structure with a common center support frame, the first support structure being sized for receiving the truck bed of a truck;

a monorail being fixedly attached to the first support structure, the center support frame and the second support structure, the monorail having at least one snatch winch being coupled thereto and capable of traversing a length of the monorail;

a rail system being formed by a pair of parallel track members and fixedly attached to the second support structure;

a conveyance trolley slidable mounted to the rail system; and a universal rack being suspended from the snatch winch of the monorail for supporting a load of material to be moved through a processing plant, the universal rack having at least one small jigging monorail with at least two jig winches.

2. The universal rack loading/unloading system as set forth in claim 1, wherein the first support structure has a first support frame coupled with the center support frame by a plurality of side bar members, the plurality of side bars forming a pair of right side bars coupled to a right side cross bar, and a pair of left side bars coupled to a left side cross bar.

3. The universal rack loading/unloading system as set forth in claim 1, wherein the second support structure has a second support frame coupled with the center support frame by a pair of side bar members.

4. The universal rack loading/unloading system as set forth in claim 1, wherein a plurality of adjustable work platforms are housed within the first support structure and spaced apart for receiving the truck bed therebetween.

5. The universal rack transport as set forth in claim 4, wherein each of the adjustable work platforms have a hydraulic lift for movement in an upward and downward direction about a side of the truck bed of the truck within the transfer station.

6. The universal rack loading/unloading system as set forth in claim 1, wherein the pair of parallel track members of the rail system comprise a first track member being fixedly attached to the center frame and a second track member being fixedly attached to the second support frame.

7. The universal rack loading/unloading system as set forth in claim 1, wherein the universal rack has a grab bar with at least one grab loop for releasable coupling with the snatch winch.

8. The universal rack loading/unloading system as set forth in claim 1, wherein the universal rack is positionable onto the conveyance trolley for transporting the load of material along the rail system, the conveyance trolley having a pair of parallel trolley trucks.

* * * * *